United States Patent [19]

Shames et al.

[11] 4,221,338

[45] Sep. 9, 1980

[54] COMBINATION SPRAY AND AERATOR

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 10,494

[22] Filed: Feb. 8, 1979

[51] Int. Cl.[2] ..... B05B 1/16; E03C 1/084

[52] U.S. Cl. ..... 239/428.5; 239/437; 239/449; 239/DIG. 18

[58] Field of Search ..... 239/DIG. 18, 428.5, 239/436, 437, 442, 443, 446–449; 261/DIG. 22

[56] References Cited

U.S. PATENT DOCUMENTS

| | | | |
|---|---|---|---|
| 170,397 | 11/1875 | Reid | 239/449 |
| 3,623,670 | 11/1971 | Wakeman | 239/437 X |
| 3,786,995 | 1/1974 | Manoogian et al. | 239/428.5 |
| 3,902,671 | 9/1975 | Simmons | 239/428.5 |
| 3,998,390 | 12/1976 | Peterson et al. | 239/443 X |

*Primary Examiner*—Robert W. Saifer
*Attorney, Agent, or Firm*—Norman Lettvin

[57] ABSTRACT

A spray and aerator faucet appliance is provided by a construction wherein the selection of water discharge is effected by merely rotating the water discharge head portion of the appliance until the desired water discharge from the appliance appears. Selectivity is achieved by providing two abutting internal parts, each with a flow passageway located eccentric of the axis of the appliance, with seal means for the eccentric flow passageway provided between the abutting parts, for permitting selection either of flow only through the eccentric flow passageways when aligned, or no flow through the eccentric passageways when not aligned, thereby permitting discharge of flow through an alternate flow path. Each of the two abutting internal parts is locked internally of the appliance to one of the two portions of the appliance between which relative rotation is effected by rotating the discharge head. All parts of the appliance, except for the seals and screens, are inexpensively executed in plastic.

9 Claims, 7 Drawing Figures

FIG. 4
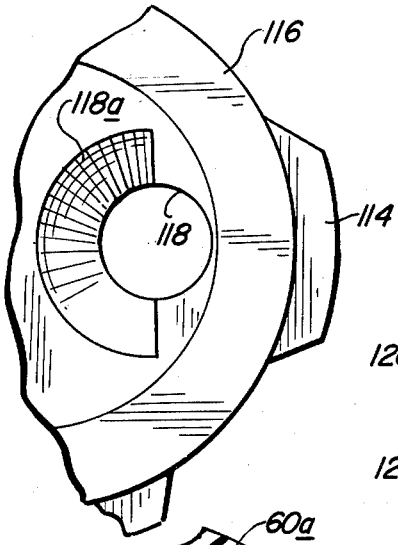
FIG. 3
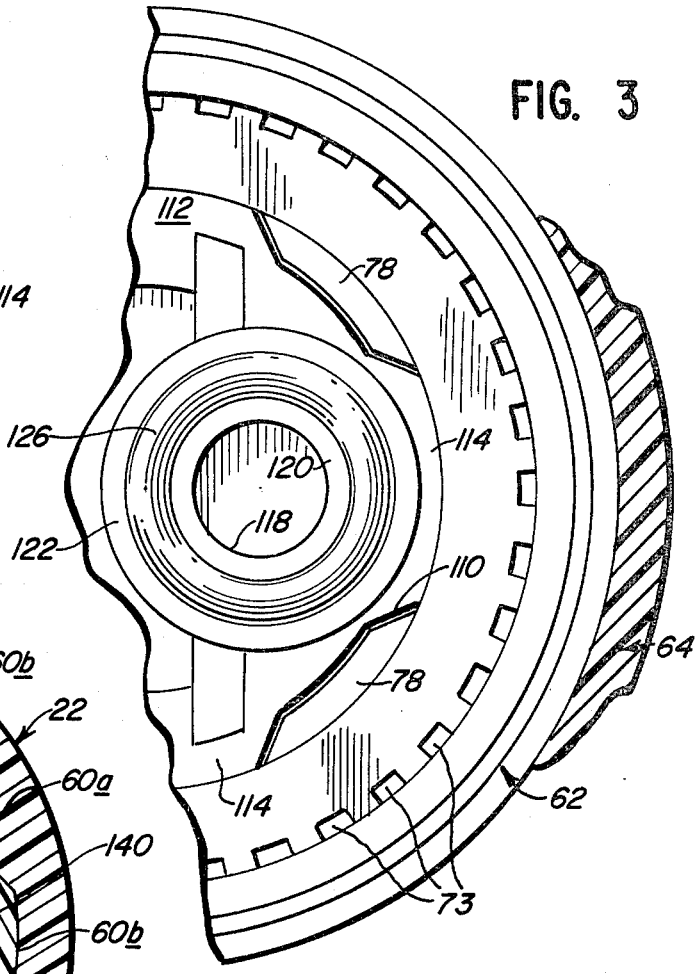
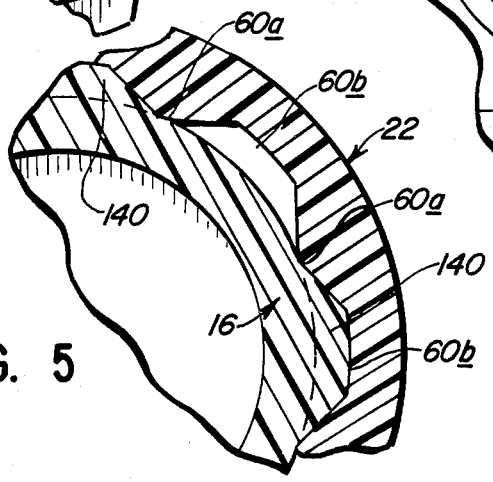
FIG. 5
FIG. 1
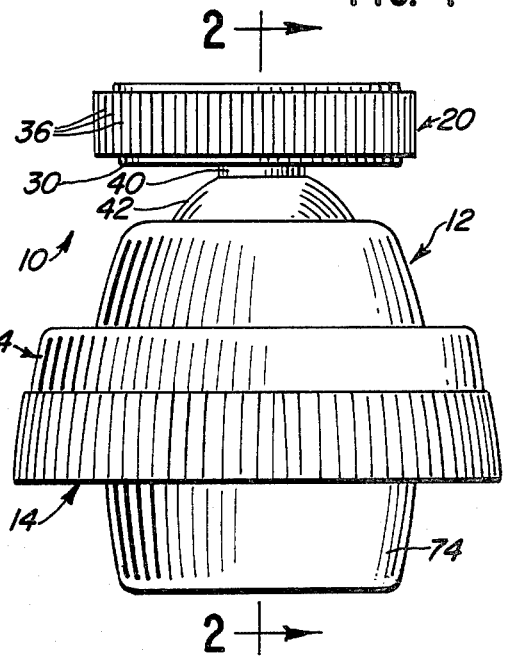
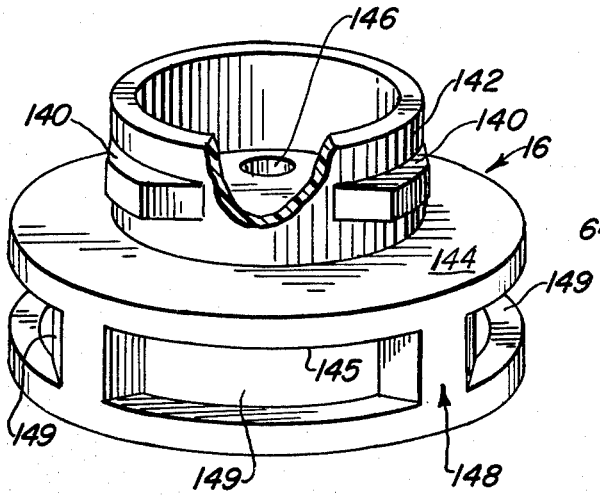
FIG. 6

FIG. 2
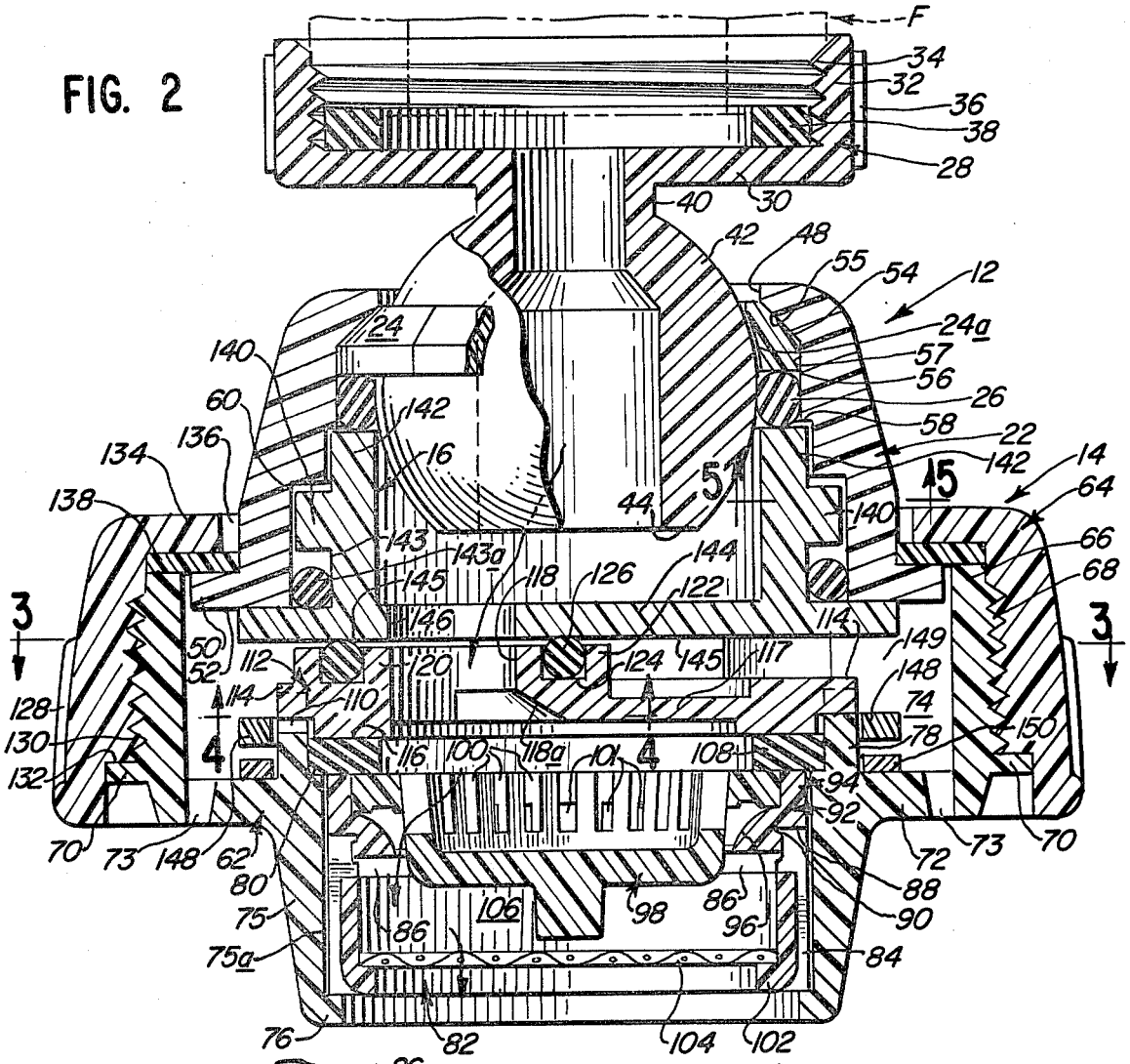
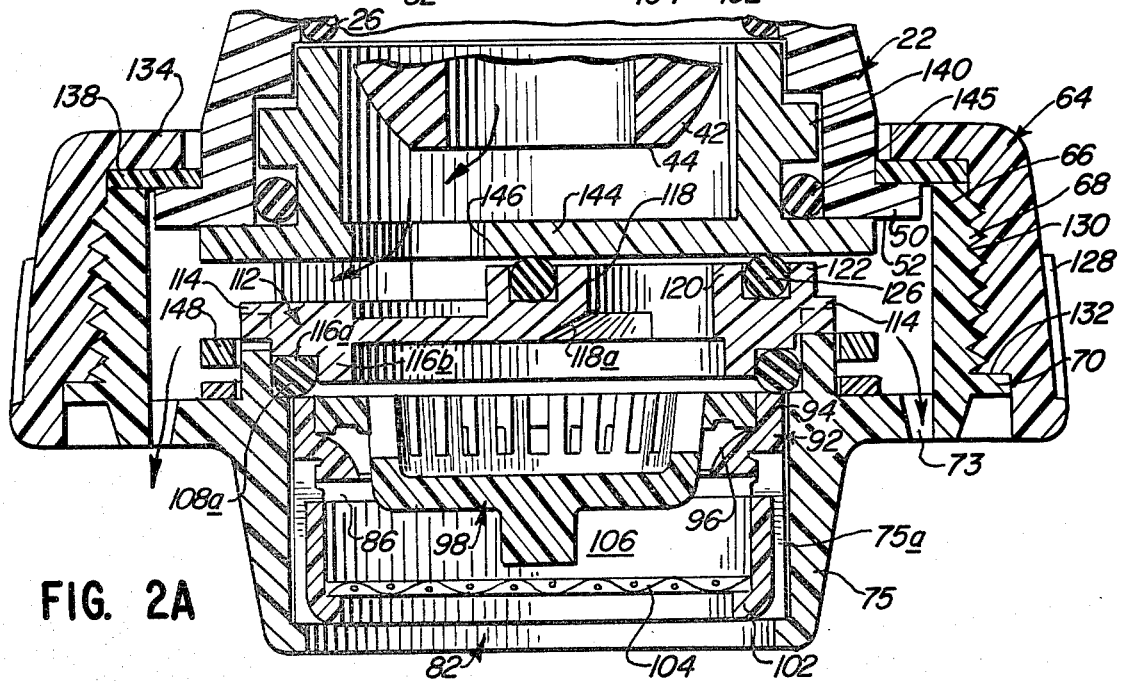
FIG. 2A

COMBINATION SPRAY AND AERATOR

FIELD OF THE INVENTION

The present invention relates to a spray and aerator faucet appliance, and more particularly to such an appliance that may be selectively caused to discharge liquid therefrom, either as a spray or as an aerated stream, merely by rotating the liquid discharge head portion of the appliance until the desired flow appears.

BACKGROUND OF THE INVENTION

For many years separate water spray and aerated water stream appliances have been used in kitchens. The desirability of a single appliance that would deliver, selectively, either a spray or an aerated stream therefrom is also well known, and such alternative-flow appliances are generally known as a spray-or-aerator.

Prior spray-or-aerator appliances have been achieved in a turret head arrangement wherein separate spray or aerator discharge heads may be selectively rotated into alignment with the incoming flow, or in a shiftable head arrangement wherein through an axial movement of a discharge head, between upstream and downstream positions, the water flowing through the discharge head is directed either through spray orifices or through the aerator.

Such prior constructions have almost invariably used at least some metal parts therein and have been relatively expensive, and have been observed to provide some difficulties for users of the appliance to secure full benefit of the alternate usages during the life of the appliance, so that the user continues to use the appliance only in one of the two alternate modes of usage.

Thus, the object of this invention is to provide an improved spray-or-aerator appliance that avoids usage of metal parts, that is relatively inexpensive, and that has simple means for effecting selective flow therefrom by merely rotating the spray head portion of the appliance to a position at which the desired flow is achieved.

Further objects of this invention will become apparent to one skilled in the art from the following description of the invention.

BRIEF SUMMARY OF THE INVENTION

The improved construction of this spray-or-aerator invention includes an upstream adapter means portion constructed to achieve liquid tight securement to the discharge end of a faucet, to provide for selective pivotable angling of the discharge end of the appliance about a ball joint, and to provide relative non-rotatable character for said upstream adapter means. The upstream adapter means is also shaped and arranged to provide therein an upstream, non-circular internal socket. A spray-or-aerator discharge head with two alternate flow paths therethrough is rotatably arranged relative to, and downstream of, the upstream adapter means that has relative non-rotatable character. The discharge head is shaped and arranged to provide thereon a non-circular internal socket. An internal diverter means is provided, between the upstream adapter means and the downstream discharge head. The diverter means consists of upstream and downstream parts each with a disc portion for abutting the other disc portion and with a flow aperture through each disc portion positioned eccentrically of the axis of the rotatable discharge head. A planar seal means is provided between said disc portions for isolating and confining liquid flow along either of two separate flow paths that extend downstream of the upstream apertured disc. The upstream part of the internal diverter means is locked to the upstream adapter means through the upstream non-circular internal socket. The downstream part of the internal diverter means is locked to the non-circular internal socket of the discharge head. The two flow paths in the discharge head, that are downstream of the upstream apertured disc of the internal diverter means, lead respectively to a spray means and an aerator that are concentrically located at the discharge end of the discharge head.

BRIEF DESCRIPTION OF THE DRAWINGS

FIG. 1 is a side elevational, enlarged view of the appliance of the application from which a spray or aerated stream of water may be discharged;

FIG. 2 is a greatly enlarged, vertical, axial cross-sectional view of the appliance taken substantially on line 2—2 of FIG. 1, and showing the position of the internal parts when the appliance is for delivering a coherent aerated stream therefrom;

FIG. 2A is a fragmentary cross-sectional view similar to the view of the lower portion of FIG. 2, but showing the position of the internal parts when the appliance is for delivering a spray therefrom, and also showing a modified form of seal construction upstream of the aerator portion of the appliance;

FIG. 3 is a fragmentary top plan view taken substantially on line 3—3 of FIG. 2, showing the upstream side of the disc that overlies the aerator rotated 180° from the position in FIG. 2;

FIG. 4 is a fragmentary, reduced size, bottom plan view of a portion of the disc shown in FIG. 3;

FIG. 5 is a fragmentary, reduced size, cross-sectional view taken substantially on line 5—5 of FIG. 2 showing the locking of the internal diverter member to the annular ball-fitting housing; and FIG. 6 is a perspective view, with a portion broken away, of the internal diverter member that is seen in vertical cross-section in FIG. 2.

DETAILED DESCRIPTION OF THE DRAWINGS

Referring now to the drawings, the spray-or-areator appliance is generally indicated at 10 and comprises three principal constituents: an upstream adapter means 12, a downstream discharge head generally 14, and an internal diverter member 16.

The upstream adapter means 12 includes a ball connector part 20, ball-fitting housing 22, a snap-ring retainer 24, and an O-ring seal 26.

The ball connector part 20 includes an upstream, screw-threaded, annular coupling portion 28 of general cup-shape adapted for connection to a source of liquid under pressure, such as a faucet spout F. The coupling 28 provides a transverse wall 30, an upstream extending sleeve 32 that is female threaded at 34, with exterior knurling or fluting at 36 to provide the necessary grip means for attaching the coupling 28 manually to a faucet. Within coupling 28 and abutting the transverse wall 30 is a resiliently compressible and deformable rubber washer 38 that provides the desired sealing and frictional connection between coupling 28 and faucet F.

Extending downstream from coupling 28 is an annular neck 40 that merges with an annular ball member 42 that has a downstream annular terminus 44 that is spaced downstream of the maximum diameter portion of the ball member 42. The adapter 20, neck 40, and ball member 42 are portions of a single integrated part molded of plastic.

The adapter means 12 also includes an annular ball-fitting housing 22 in the form of an elongated shell with an upstream minimum inner diameter opening at 48 that is of greater size than the maximum diameter portion of ball member 42. This permits a telescopic assembly of ball member 42 with housing 22 through the upstream opening 48 of housing 22. The downstream end of housing 22 has an outwardly extending annular flange 50 that partially defines a downstream annular abutment surface 52 at the downstream end of housing 22. The interior of housing 22 is shaped to define an upstream frustro-conical seat 54 that merges with a cylindrical wall 56. The snap ring 24 has exterior surfaces 55 and 57 that respectively complement frustro-conical seat 54 and cylindrical wall 56, and an interior spherical surface 24*a*. The snap ring 24, which, during assembly, is introduced into housing 22 past ball member 42 when the two parts have been telescoped together, serves the purpose of reducing the upstream inner diameter opening of the assembly and thereby capturing and retaining ball member 42 within housing 22. The spherical surface 24*a* permits angling of housing 22, augmented with snap ring 24, relative to ball 42. The downstream edge of retainer ring 24 serves as an abutment for O-ring 26. The O-ring 26 is selected of a size to provide substantial sealing pressure against both the ball member 42 and cylindrical wall 56 of housing 22 to provide liquid tight seals, and, at the same time, to develop sufficient friction between itself and the said members 42 and 22 so that when the housing 22 is angled relative to ball maember 42, the parts will be retained in their angled position until moved to another position by the user of the appliance.

There is also formed downstream of cylindrical wall 56 an annular stop shoulder 58. Another interior wall portion of housing 22, downstream of shoulder 58, has a non-circular socket means 60, best seen in FIG. 5, formed therein by eight lands 60*a* and eight recesses 60*b* disposed alternately about the inner circumference of housing 22.

The downstream discharge head 14 includes an annular molded body 62 and an annular molded rotor 64. The body 62 serves as a guide for the spray and aerated stream. Body 62 is generally cup-shaped to define an outer upstream extending sleeve 66 that is male threaded at 68 and with outwardly extending exterior stop flanges 70. The body 62 also provides an annular transverse discharge wall 72 extending radially inwardly of sleeve 66 and which has defined therein a set of circumferentially spaced, relatively small, spray discharge apertures 73 that communicate with an annular flow chamber 74 that is bounded by the upstream extending sleeve 66.

Adjacent the radial innermost extent of annular transverse wall 72 there is defined a downstream extending imperforate sleeve 75 providing thereon an inner cylindrical sleeve wall 75*a* and with an inturned support flange 76 provided at the downstream terminus of sleeve 75. Upstream of the sleeve 75 there is an upstream extending centering sleeve 78 that surrounds an inner annular support shoulder 80. The cylindrical sleeve wall 75*a* and flange 76 define a large central flow passageway 82 in body 62. The large flow passageway 82 and the smaller separate spray flow apertures 73 are concentric.

The flow passageway 82 is constructed to slidably receive thereinto an assemblage of parts for effecting aeration of water passing through passageway 82. This assemblage of aerating parts is similar to that shown in FIG. 1 of U.S. Pat. No. 3,684,191, wherein aeration is achieved by using air that is drawn upstream through an imperforate sleeve, such as the sleeve 75 provided herein, to be ingested and mixed with water jets that are broken up and mixed with the ingested air before exiting as a coherent aerated stream.

The parts shown include an annular molder lower sleeve-part spacer 84 that is spaced by exterior ribs defined thereon from the inner wall 75*a* of the sleeve 75, so as to provide air passageways that communicate with lateral air inlet passageways 86 that communicate with and air-and-water mixing chamber 106. The spacer 84 is shaped to provide upstream shoulder means 88 with inturned locking rib means 90 that cooperate with and attach to a shaped upstream ring 92 having an upstream sleeve portion 94 that merges with a downstream, convex annular abutment surface 96 against which jets of water impinge to be fragmented prior to mixing with ingested air in mixing chamber 106. A cup-shaped, flanged, plug member 98 is slidably received in sleeve 94. Plug member 98 provides a series of cylindrically spaced, stream-defining radial slits 100 with jet-defining exit apertures 101. The spacer 84 provides thereon an inner annular lip 102 that holds a downstream screen means 104 that constitutes the downstream boundary of air-and-water mixing chamber 106. An upstream resilient seal washer 108, in the form of an annular disc-shaped rubber washer, or a molded O-ring, is positioned radially outwardly of stream-defining slits 100 and is supported on the upstream surfaces of shoulder 80 and the upstream edge of sleeve 94, and may be of a size to also engage a portion of upstream surface of the flange of plug member 98.

While the details of the aerator have been recited herein for purposes of completeness, it should be understood that the details of the construction of the aerator itself form no part of the invention herein disclosed, as the aerator construction is itself disclosed in U.S. Pat. No. 3,684,191.

The centering sleeve 78 of body 62 extends upstream of sealing washer 108 and has an upstream edge that is formed therein with a plurality of circumferentially spaced, depressed, recesses 110. An upstream, disc-shaped, eccentrically apertured, adapter 112 is constructed with flanges 114 adapted for entry into recesses 110. The adapter 112 thus cooperates with the centering sleeve 78 to overlie the large central flow passageway 82, and to provide for limited flow entry to flow passageway 82. This upstream adapter 112 is a molded plastic part with a downwardly extending annular flange 116, located inwardly of sleeve 78 and arranged for compressive and sealing engagement with resilient seal washer 108. Adapter disc 112 provides an upstream-facing central disc 117 with a flow aperture 118 therethrough that is eccentric of the longitudinal axis of passageway 82. Surrounding the upstream end of eccentric flow passageway 118 is an abutment portion of disc 112 in the form of a pair of upstream extending, concentric, spaced flanges, namely inner flange 120 and outer flange 122, defining therebetween an annular recess 124 for receiving thereinto an O-ring seal 126 of a size, when not compressed, to project above the upstream edges of flanges 120 and 122 that define an abutment plane. The downstream end of flow-passageway 118 is enlarged by a relief 118*a*, as best seen in FIGS. 2 and 4, which permits the stream of water to spread out radially as the water passes downstream of disc 117.

The annular rotor 64 of the discharge head 14 is a cup-shaped molded plastic annulus with exterior knurling or fluting 128 to provide a grip for manual operation, and with interior female threading 130 for cooperation with male threads 68 on body 62. An inner annular shoulder 132 on rotor 64 receives the stop flanges 70 on body 62 in abutting relation. The upper transverse annular wall 134 of rotor 64 is of a radial inward extent to overlap the flange 50, but to be spaced from the side wall of ball-fitting housing 22 as shown by annular space 136.

A teflon washer 138 that provides resilience but little rotary friction is positioned between wall 134 and flange 50 and is also located between rotor wall 134 and the upstream edge of sleeve 66. This construction permits of easy manual rotation of discharge head 14 relative to housing 22, while housing 22 itself is retained in non-rotating position by the friction developed between it and O-ring 26.

Between the housing 22 of upstream adapter means 12 and downstream discharge head 14 there is provided an internal diverter member 16. Details of construction of internal diverter member 16 will be seen in FIGS. 2 and 6. Said member 16 includes an upstream portion with circumferentially spaced non-circular means, in the form of four lugs 140 shaped to interfit with alternate recesses 60*b* of socket means 60 on housing 22, as seen in FIG. 6, to lock member 16 against rotation relative to the adapter means 12. The non-circular means 140 are provided on the outer wall of an axially elongated sleeve 142 that merges at its downstream end with a transverse disc 144. The sleeve 142 extends upstream of non-circular means 140, a length sufficient to engage O-ring 26, as seen in FIG. 2, to prevent O-ring 26 from migrating downstream of the ball member 42. The portion of sleeve 142 downstream of non-circular means 140 cooperates with disc 144 to provide an axially elongated recess 143 for receiving an O-ring 143*a* therein that permits sliding axial movement while maintaining a seal with sleeve 142.

The upstream adapter means 12 is provided with an eccentrically apertured, downstream central disc 144. Disc 144 is of a diameter greater than the maximum inner diameter of annular housing 22, so that the upstream side of the outer annulus of disc 144 abuts the abutment surface 52. The eccentric flow aperture 146 in disc 144 is of the same size as the eccentric flow aperture 118 of downstream disc 117. Disc 144 is of greater diameter than disc 117 and is adapted to abut the upstream projecting portion of disc 117, namely sleeves 120 and 122 and O-ring 126. A flange means 148 at the periphery of upstream disc 144 extends downstream from disc 144 to loosely surround the periphery of disc 117. The flange means 148 are laterally apertured at 149, as best seen in FIG. 6, to provide for flow communication between flow aperture 146 in disc 144 and annular flow chamber 74 when the parts are in position shown in FIG. 2A, the flow being illustrated generally by the flow arrows. An annular teflon washer 150 is provided surrounding flange 78 and is positioned between the downstream edge of flange means 148 and transverse wall 72.

The downstream planar wall 145 of upstream disc 144 bears against and compresses O-ring seal 126 while permitting relative sliding movement therebetween about the longitudinal axis of the appliance, for all positions. The amount of compression of O-ring 126 is limited by engagement of wall 145 with the upstream edges of sleeves 120 and 122.

From the foregoing description, the operation of the appliance will be understood. When the coupling 28 is secured to a spout or faucet F by screw-on tightening, sufficient friction is developed so that coupling 28 is considered relatively stationary. The housing 22 is maintained stationary relative to ball member 42 by reason of friction developed through O-ring 26, except that housing 22 may be selectively angled, as desired, relative to ball 42 of the coupling part.

The discharge head 14, consisting of body 62 and rotor 64, is rotatable relative to the axis of housing 22 and its flange 50. As discharge head 14 rotates, disc 112 rotates with head 14. The friction developed between O-ring 26 and housing 22 keeps housing 22 from rotating with discharge head 14. The upstream adapter means 16, being locked to the housing 22, does not rotate with disc 112, so that the eccentric aperture 118 in disc 112 will be moved relative to aperture 146 in disc 144 between the position of alignment seen in FIG. 2 and the position of non-alignment seen in FIG. 2A. The O-ring 126 provides a seal between discs 112 and 144 in both positions.

In FIG. 2, water passing through the aligned apertures is channeled to the aerator in flow passageway 82, as illustrated by the flow arrows. In FIG. 2A, water passing through the upstream aperture 146 flows around and about outer flange 122 and through lateral passageways 149 in diverter member 16 to move into annular chamber 74 from whence flow discharges through the set of spray discharge apertures 73.

The tightening up of threads, or screw-together, of body 62 and rotor 64 operates to compress teflon washer 138 therebetween, to also draw wall 134 toward flange 50 with washer 138 therebetween, to also bias seal 108 upstream against annular abutment 127 on disc 112 while biasing disc 112 upstream toward disc 144 to compress O-ring seal 126 therebetween, while simultaneously biasing disc 144 upstream against the downstream end of housing 22 and biasing the upstream edge of sleeve 142 upstream against O-ring 26, all to effect proper seals where needed, to develop friction where desired and intended, and to hold all the parts in assembly as shown in FIG. 2.

In FIG. 2A, a modified form of seal construction between disc 112 and the structure of the aerator is shown. The disc 112 is provided with a downstream extending sleeve 116*b* that is located radially inwardly of a flange 116*a* that is positioned to engage an O-ring seal member 108*a*, the sleeve 116*b* serving as a centering stud for locating and confining the O-ring seal member 108*a*.

While particular embodiments of this invention have been shown and described, it will be obvious to those skilled in the art that various changes and modifications may be made therein without departing from the spirit and scope of the invention, and, therefore, it is intended in the appended claims to cover all such changes and modifications which fall within the true spirit and scope of the invention.

What is claimed is:

1. In a spray-or-aerator appliance that includes an upstream axially elongated adapter means through which flowing liquid is introduced into the appliance from a source under pressure, and a downstream discharge head shaped and arranged to provide, at the discharge end thereof, two concentric flow passageway means including a relatively large central passageway with an aerator construction therein, and an outer annulus of circumferentially spaced, smaller, spray apertures; the improvement comprising, in combination:

the upstream adapter means having relatively non-rotatable character and being shaped to provide adjacent its downstream end an internal, non-circular, socket means surrounding a central flow passageway;

the discharge head being axially positioned upon the downstream end of said adapter means and being rotatable relative to said adapter means, the discharge head providing therein an upstream facing central disc with an eccentric aperture therein, said upstream facing disc being operative to substantially close off liquid flow to the large central passageway except through said eccentric aperture;

an internal diverter member positioned between said upstream adapter means and the discharge head, said diverter member being shaped to provide: (a) an upstream non-circular means for interfitting engagement with the non-circular socket means of the upstream adapter means; (b) an eccentrically apertured, central disc adapted for abutment with a portion of the central disc of the discharge head; and (c) laterally apertured flow means positioned in a flow path between said eccentrically apertured central disc of the diverter member and the circumferentially spaced spray apertures of the discharge head; and compression seal means positioned between portions of the central discs of the internal diverter and of the discharge head, and surrounding the eccentric aperture in the central disc of the discharge head, for isolating downstream liquid flow in the discharge head either through only the pair of aligned eccentric apertures of the two discs, so that said flow will be directed through the large central passageway of the discharge head, or through an alternate flow path, that includes said laterally apertured flow means of the diverter member when the eccentric apertures are not aligned, that communicates with the outer annulus of smaller spray apertures in the discharge head.

2. An appliance as in claim 1 wherein the upstream adapter means includes: an upstream, screw-threaded, annular coupling and a downstream, centrally apertured, spherical ball member integrally formed as a single member; an axially elongated ball-fitting means constructed for cooperation with the ball member to provide for swivel thereof relative to the ball member; and an O-ring compressed between the ball-fitting means and the spherical ball member to both effect a liquid seal therebetween and to develop such friction that the ball-fitting means is substantially non-rotatable relative to the spherical ball member although capable of swivel movement relative to the ball member.

3. An appliance as in claim 2 wherein the downstream end of the ball-fitting means is provided with an outwardly extending annular flange with which the discharge head cooperates through a rotatable connection to locate the discharge head axially relative to the ball-fitting means while permitting rotation of the discharge head in either of opposite directions relative to said ball-fitting means.

4. An appliance as in claim 2 wherein the ball-fitting means includes: an axially elongated, annular shell part whose minimum inner diameter is greater than the diameter of the ball member to permit entry of the ball member into the shell part; and a snap ring for entry into and assembly onto the shell part adjacent the minimum inner diameter of the shell part and upsteam of the maximum diameter of the ball member to provide a restraint against separation of the ball member from the annular shell part.

5. An appliance as in claim 4 wherein said O-ring is resiliently forced upstream of the maximum diameter of the ball member into abutting engagement with the snap ring.

6. An appliance as in claim 5 wherein the internal diverter member includes a cylindrical sleeve that extends upstream of said non-circular means to engage the O-ring to prevent migration of the O-ring downstream relative to the ball member.

7. An appliance as in claim 2 wherein the ball-fitting means includes: an axially elongated annular shell part with an outwardly extending annular flange at its downstream end; and the downstream central disc of the internal diverter member having a diameter greater than the maximum inner diameter of said annular flange, whereby the upstream side of said central disc of the diverter member is engaged by the annular flange while the downstream planar side of said central disc of the diverter member engages said compression seal means.

8. An appliance as in claim 1 wherein the discharge head includes an annular rotor member with an inturned upstream flange adapted for axial retention cooperation with an annular retainer flange provided on the upstream adapter means to limit downstream movement of said annular rotor member, a threaded sleeve portion provided on said rotor member downstream of said upstream flange, and a molded body with concentric flow discharge means therein screw-threaded to the sleeve portion of the rotor member.

9. An appliance as in claim 8 including a teflon washer positioned between the inturned upstream flange of the rotor member and the annular retainer flange on the upstream adapter means, to provide for sealing while permitting rotation of the discharge head and molded body together as a unit relative to the upstream adapter means.

* * * * *